US009138802B2

(12) United States Patent
Murata et al.

(10) Patent No.: US 9,138,802 B2
(45) Date of Patent: Sep. 22, 2015

(54) FORGING SYSTEM FOR FORGING A VALVE

(75) Inventors: Yorikazu Murata, Hadano (JP); Yuji Okamura, Hadano (JP); Yosuke Makino, Hadano (JP); Hiroyuki Oda, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 0 days.

(21) Appl. No.: 14/371,353

(22) PCT Filed: Mar. 30, 2012

(86) PCT No.: PCT/JP2012/058729

§ 371 (c)(1),
(2), (4) Date: Jul. 9, 2014

(87) PCT Pub. No.: WO2013/145308

PCT Pub. Date: Oct. 3, 2013

(65) Prior Publication Data

US 2014/0352389 A1 Dec. 4, 2014

(51) Int. Cl.

| | |
|---|---|
| ***B21J 9/02*** | (2006.01) |
| ***B21K 27/04*** | (2006.01) |
| ***B21K 1/20*** | (2006.01) |
| ***B21J 13/10*** | (2006.01) |
| ***B21J 9/08*** | (2006.01) |

(52) U.S. Cl.
CPC *B21J 13/10* (2013.01); *B21J 9/022* (2013.01); *B21J 9/08* (2013.01); *B21K 1/20* (2013.01); *B21K 27/04* (2013.01)

(58) Field of Classification Search
CPC ..... B21J 9/00; B21J 9/02; B21J 9/022; B21J 9/06; B21J 9/08; B21J 13/10; B21K 27/00; B21K 27/02
See application file for complete search history.

(56) References Cited

U.S. PATENT DOCUMENTS

| | | | | |
|---|---|---|---|---|
| 3,728,887 | A * | 4/1973 | Bachmann | 72/318 |
| 4,484,464 | A * | 11/1984 | Nihei et al. | 72/38 |
| 5,054,301 | A * | 10/1991 | Soga et al. | 72/13.5 |

FOREIGN PATENT DOCUMENTS

| | | | |
|---|---|---|---|
| JP | 06-143084 | A | 5/1994 |
| JP | 10-166287 | A | 6/1998 |
| JP | 2002-273539 | A | 9/2002 |

OTHER PUBLICATIONS

International Search Report, dated Jul. 3, 2012, issued in corresponding application No. PCT/JP2012/058729.

* cited by examiner

*Primary Examiner* — Teresa M Ekiert
(74) *Attorney, Agent, or Firm* — Westerman, Hattori, Daniels & Adrian, LLP

(57) ABSTRACT

A forging press device for valve including an upsetter in which a plurality of primary forming stages are provided, a forging press main body adjacent to the upsetter, that secondarily forms a primary formed workpiece, and a workpiece conveyance/carry-in device which grips and conveys the workpiece, to carry it into the forging press main body, the device in which the workpiece conveyance/carry-in device is composed of a high speed multi jointed robot capable of circling around a vertical shaft, which has an arm (a chuck) gripping the workpiece. In accordance with the invention, it is possible to provide a forging press device for valve in which the number of deliveries of workpiece from the upsetter to the forging press main body is decreased, which speeds up a valve forging line, and improves the production efficiency.

3 Claims, 11 Drawing Sheets

FORGING SYSTEM FOR FORGING A VALVE

TECHNICAL FIELD

The present invention relates to a forging press device for valve which conveys a primary formed workpiece formed in an upsetter to a forging press main body, to perform secondary formation thereof, and in particular, to a forging press device for valve including a high speed multi-jointed robot capable of circling around a vertical rotary spindle, that grips a primary formed workpiece formed in an upsetter with its arm, to convey/carry it into a forging press main body.

BACKGROUND ART

Formation by an upsetter is a method in which a round bar material is gripped with an electrode to apply electric current between the electrode and a round bar end, and is pressurized from the other end, thereby bulge-forming its heated end into a ball shape at a forming stage provided on the front surface of the upsetter, and the method has been commonly used for a forging press device for valve.

Then, it takes more than ten seconds to several tens of seconds to perform primary formation in an upsetter. On the other hand, it takes only one second to several seconds to perform secondary formation (pressing) by a forging press main body, and therefore, in order to increase production efficiency of the valve forging press, for example, about four upsetters are combined with one forging press.

To describe in detail, with respect to a conventional forging press device for valve composing a valve forging automation line, as described in the section of the conventional art in the following Patent Document 1, the upsetters are arrayed in one line on one side of the forging press main body, and primary formed workpieces formed in the respective upsetters are dropped into a chute by an ejector, to pass through the chute, and thereafter, those are dropped onto a top-chain conveyor, to reach a primary formed workpiece receiver in the vicinity of the forging press main body, to stop. Here, a multi-jointed robot installed in front of the forging press main body goes to take the primary formed workpieces, to carry those into a metallic mold of the forging press, and a workpiece carry-out device carries secondary formed workpieces out at the same time of completion of forging press.

However, in the aforementioned forging press device (the device described in the section of the conventional art in Patent Document 1), the primary formed workpieces are conveyed only from the one side of the forging press main body to the vicinity of the forging press main body. Therefore, there is the problem that it takes time to convey the workpieces from the upsetter located furthest from the forging press main body by the delivery conveyor, and the like, that is, a time required for production per secondary formed workpiece is long, which is extremely unproductive.

Then, as shown in the invention of the following Patent Document 1, there has been proposed a forging press device in which upsetters, delivery conveyors, and primary formed workpiece carry-in devices are disposed on the both sides centering on the opening of the forging press main body, and primary formed workpieces are carried-in from the both sides of the forging press main body, thereby shortening a time required for production per secondary formed workpiece.

PRIOR ART DOCUMENT

Patent Document

Patent Document 1: Japanese Published Unexamined Patent Application No. 2002-273539 (Paragraphs 002 to 007, FIGS. 7, 8, and 9, Paragraphs 0014 to 0016, and FIGS. 1 and 2)

SUMMARY OF THE INVENTION

Problems to be Solved by the Invention

However, in the device described in Patent Document 1 mentioned above, in any structure, it takes time to convey primary formed workpieces formed in (at the stages of) the upsetters and carry those into the forging press main body, that is, it has not been achieved to sufficiently shorten a time required for production per secondary formed workpiece.

As a result of consideration of the cause by the inventor, it has been understood that it is the principal factor responsible for reduction in production efficiency to perform four deliveries of workpiece of the upsetter→the workpiece carry-out mechanism→the delivery conveyor→the workpiece carry-in device (including the multi-jointed robot)→the forging press main body from carry-out/conveyance of a primary formed workpiece formed in the upsetter, from the upsetter to carry-in of those to the forging press main body.

Therefore, the inventor has considered reducing the number of deliveries of workpiece (the number of devices for conveying a workpiece). To describe in detail, the inventor has considered adoption of a high speed multi-jointed robot having an arm which is capable of gripping a workpiece in place of the delivery conveyor and the workpiece carry-in device.

That is, because a high speed multi-jointed robot has the both functions of a delivery conveyor and a workpiece carry-in device, the number of devices for conveying a primary formed workpiece formed in an upsetter, to carry it into the forging press main body is reduced by one (the number of deliveries of workpiece is reduced by one), thereby it is possible to shorten a delivery time. Moreover, as a device for gripping a primary formed workpiece at a predetermined position, to carry it into a forging press main body, conveyance by a high speed multi-jointed robot which is capable of circling around the vertical rotary spindle among various conveyor mechanisms is appropriate and fastest.

Then, the effect thereof has been confirmed as a result of repeated trial productions by the inventor, which led to this patent application.

The present invention has been made in view of the problem in the aforementioned conventional technology. An object of the present invention is to provide a forging press device for valve in which a high speed multi-jointed robot which is capable of circling around a vertical rotary spindle, the robot has an arm gripping a primary formed workpiece is adopted in place of the conveyor which conveys a primary formed workpiece to the vicinity of a forging press main body, and the carry-in device which carries the primary formed workpiece conveyed by the conveyor into the forging press main body, thereby it is possible to convey/carry a primary formed workpiece formed in an upsetter into the forging press main body in a short time.

Means for Solving the Problems

A forging press device for valve according to the present invention includes at least one upsetter in which a forming stage is provided at its front surface, the upsetter grips a round bar material serving as a workpiece with an electrode, to apply electric current between the electrode and an end of the round bar material, and pressurize it from the other end, thereby bulging its heated end into a ball shape, a workpiece feed device which is installed on a front surface side of the upsetter, that feeds a workpiece to the forming stage, a forging press main body which is disposed adjacent laterally to the upsetter, and secondarily forms a primary formed workpiece formed in the upsetter with upper and lower metallic molds, and a primary formed workpiece conveyance/carry-in device which is disposed in the vicinity of the upsetter and the forging press main body, that grips and conveys the primary formed workpiece formed in the upsetter, to carry it into the forging press main body, the forging press device for valve in which the workpiece feed device is configured to include a workpiece feeding chuck which is slidable in a front-back direction of approaching and departing from the upsetter, and in a horizontal direction with respect to the upsetter, and the primary formed workpiece conveyance/carry-in device is composed of a high speed multi-jointed robot which is capable of circling around a vertical rotary spindle, the robot has an arm which grips the primary formed workpiece on the front surface side of the upsetter, to convey/carry it into the forging press main body.

(Operation) The workpiece feeding chuck of the workpiece feed device grips, for example, a round bar material serving as a workpiece in a workpiece feeding route of the workpiece feed device, to quickly and reliably feed the round bar material to the forming stage of the upsetter.

While a primary formed workpiece formed at the forming stage of the upsetter is carried from the upsetter into the forging press main body, in the conventional device, four deliveries of workpiece of the upsetter→the workpiece carry-out mechanism→the delivery conveyor→the workpiece carry-in device (including the multi-jointed robot)→the forging press main body are performed. On the other hand, in the present invention, the delivery conveyor and the workpiece carry-in device are replaced by the high speed multi-jointed robot. That is, because the high speed multi-jointed robot performs conveyance and carry-in of a workpiece, the number of deliveries of workpiece (the number of devices for conveying a workpiece) is decreased by at least one time (one), thereby it is possible to shorten a time during which the primary formed workpiece is conveyed/carried into the forging press main body.

In particular, as a device for gripping a primary formed workpiece at a predetermined position to carry it into the forging press main body, conveyance by a high speed multi-jointed robot which is capable of circling around a vertical rotary spindle, the robot has an arm which grips a primary formed workpiece, to convey/carry it into the forging press main body as appropriate and fastest among various conveyor mechanisms, which is most desirable.

In accordance with a second aspect, in the forging press device for valve according to the first aspect, a plurality of the forming stages are installed side by side horizontally on the front surface of the upsetter.

(Operation) In the upsetter used in the conventional forging press device, a forming stage is limited to one place in one upsetter, and in order to increase the production efficiency, it is necessary to dispose a plurality of (for example, about four) upsetters adjacent to one another with respect to one forging press main body. Therefore, with respect to the upsetters used in the forging press device of the present invention, because the plurality of the forming stages are provided at one upsetter, a small number of upsetters may be required for one forging press main body.

Further, as compared with the conventional forging press device in which the upsetters are disposed adjacent to one another, because the upsetters are not disposed adjacent to one another, or even in the case where the upsetters are disposed adjacent to one another, because the number of upsetters is small, a distance from the forging press main body to the furthest forming stage is shortened. Therefore, the arm of the high speed multi-jointed robot is to be a form of reaching the furthest forming stage, or a form of not reaching it, but reaching at least the vicinity of the furthest forming stage. That is, a primary formed workpiece can be directly delivered from the forming stage to the arm of the high speed multi-jointed robot, or is discharged up to a predetermined position (a predetermined position which the arm of the high speed multi-jointed robot reaches) by a workpiece discharge mechanism, to be delivered to the arm of the high speed multi-jointed robot. In either case, a distance from the forming stage to delivery to the arm of the high speed multi-jointed robot is shortened, thereby shortening a time during which a primary formed workpiece formed at the forming stage of the upsetter is delivered to the arm of the high speed multi-jointed robot is shortened.

In accordance with a third aspect, in the forging press device for valve according to the first aspect or the second aspect, the workpiece feed device is configured as a workpiece feed/discharge device including a workpiece discharging chuck which is slidable in a front-back direction of approaching and departing from the upsetter, and in a horizontal direction, and the workpiece discharging chuck is configured to grip the primary formed workpiece formed at the forming stage of the upsetter, to discharge it up to a predetermined position at which it is possible to deliver it to the arm of the high speed multi-jointed robot.

(Operation) The workpiece discharging chuck of the workpiece feed/discharge device grips the primary formed workpiece at the forming stage, to discharge it up to the predetermined position, and delivers it to the arm of the high speed multi-jointed robot. Therefore, in the present invention, the number of deliveries of workpiece is three which is less as compared with the conventional forging press device which performs four deliveries of workpiece, thereby shortening a time during which the primary formed workpiece is conveyed/carried into the forging press main body.

Further, even in the case where the arm of the high speed multi-jointed robot does not reach the furthest forming stage, because the workpiece discharging chuck discharges the primary formed workpiece formed at the forming stage of the upsetter, up to the predetermined position which the arm of the high speed multi-jointed robot reaches, it is possible to adopt even a high speed multi-jointed robot with a not-so-wide arm-reachable range, for the forging press device.

Further, it takes only a short time (for example, several seconds) to feed a workpiece by the workpiece feeding chuck and to discharge a workpiece by the workpiece discharging chuck, and on the other hand, it takes, for example, more than ten seconds to perform primary formation of a workpiece by the upsetter. Therefore, in a case of a structure in which the workpiece feeding chuck discharges a workpiece as well, it is necessary for the chuck to continuously wait for a workpiece discharging operation in front of the forming stage while primary formation of a workpiece by the upsetter (the forming stage) is completed, which results in lost time. That is, after the completion of primary formation of a workpiece, the workpiece feeding chuck performs a discharging operation of the primary formed workpiece, and next receives a new workpiece, to start a workpiece feeding operation, which results in a significant amount of time.

Therefore, in accordance with the third aspect, because the workpiece discharging chuck is provided in addition to the workpiece feeding chuck in the workpiece feed device, a delivery of a new workpiece to the workpiece feeding chuck is finished while performing primary formation of a workpiece, thereby a situation is brought about in which the workpiece feeding chuck already grips the new workpiece in a situation in which the workpiece discharging chuck waits for a workpiece discharging operation in front of the forming stage. Therefore, immediately after the workpiece discharging chuck performs a discharging operation of the primary formed workpiece, the workpiece feeding chuck is capable of immediately starting a workpiece feeding operation. That is, it is possible to shorten the time corresponding to a time required for receiving a new workpiece by the chuck.

In accordance with a fourth aspect, in the forging press device for valve according to the first aspect or the second aspect, the high speed multi-jointed robot is configured to grip the primary formed workpiece on the forming stage of the upsetter with the arm, to convey/carry it into the forging press main body.

(Operation) In accordance with the third aspect, the primary formed workpiece on the forming stage is delivered to the arm of the high speed multi-jointed robot via the workpiece discharging chuck of the workpiece feed/discharge device, and on the other hand, in accordance with the fourth aspect, the arm of the high speed multi-jointed robot directly grips the primary formed workpiece on the forming stage, to convey/carry it into the forging press main body. Therefore, in contrast to the third aspect in which three deliveries of workpiece are performed while the primary formed workpiece formed in the upsetter is conveyed/carried into the forging press main body, in accordance with the fourth aspect in which the number of deliveries of workpiece is two, which is less, a time during which the primary formed workpiece is conveyed/carried into the forging press main body is considerably shortened.

In accordance with a fifth aspect, in the forging press device for valve according to the third aspect or the fourth aspect, the upsetters, the workpiece feed devices, and the high speed multi-jointed robots are respectively disposed on the both sides of the forging press main body.

(Operation) Because the arms of the pair of high speed multi-jointed robots respectively grip primary formed workpieces formed in the corresponding upsetters, to alternately and continuously convey/carry those from the right and left both sides of the forging press main body into the forging press main body, it is possible to more quickly convey/carry the primary formed workpieces into the forging press main body.

In accordance with a sixth aspect, in the forging press device for valve according to the first to fifth aspects, a heat treating furnace is provided in the vicinity of the forging press main body, and a secondary formed workpiece carry-out/transfer device which carries a secondary formed workpiece formed in the forging press main body out, to transfer it onto the heat treating furnace is disposed between the forging press main body and the heat treating furnace.

(Operation) The secondary formed workpiece formed in the forging press main body is carried out from the forging press main body by the secondary formed workpiece carry-out/transfer device, to be transferred onto a predetermined position of the heat treating furnace (for example, a workpiece delivery conveyor extending to the heat treating furnace).

In addition, as a configuration of the secondary formed workpiece carry-out/transfer device, for example, a structure including a workpiece carrying-out chuck which is slidable in a front-back direction of approaching and departing from the forging press main body and in a horizontal direction, and is further capable of an elevating operation, and a high speed multi-jointed robot which is capable of circling around the vertical rotary spindle, that includes a chuck capable of gripping a workpiece on the tip end side of the arm may be possible.

Effect of the Invention

In accordance with the forging press device for valve according to the present invention, because the number of deliveries of workpiece while a primary formed workpiece formed in the upsetter is conveyed/carried into the forging press main body is decreased, a conveyance/carry-in time of the primary formed workpiece to the forging press main body is shortened, which shortens a time required for production per secondary formed workpiece, that improves the productivity of valves.

In accordance with the second aspect, because the time during which the primary formed workpiece formed in the upsetter is delivered to the arm of the high speed multi-jointed robot is shortened, it is possible to more quickly convey/carry the primary formed workpiece continuously into the forging press main body. Therefore, a time required for production per secondary formed workpiece is considerably shortened, which reliably improves the productivity of valves.

Further, because the number of upsetters required for the forging press main body is decreased, the forging press device for valve is made compact, which makes it possible to reduce an installation space for the valve forging automation line.

In accordance with the third aspect, because the time during which the primary formed workpiece formed in the upsetter is conveyed/carried into the forging press main body is further shortened, a time required for production per secondary formed workpiece is further shortened, which further improves the productivity of valves.

Further, because the selection for high speed multi-jointed robots which can be adopted for the forging press device is broadened, by adopting an inexpensive and compact high speed multi-jointed robot with a relatively small movable range of its arm, the production facilities for the valve forging automation line are made inexpensive, which leads to reduced unit price per secondary formed workpiece.

In accordance with the fourth aspect, because the time during which the primary formed workpiece formed in the upsetter is conveyed/carried into the forging press main body is further shortened, a time required for production per secondary formed workpiece is further shortened, which further improves the productivity of valves.

In accordance with the fifth aspect, because the primary formed workpieces are carried in alternately and continuously from the right and left both sides of the forging press main body, a carry pitch of the primary formed workpieces into the forging press main body is further shortened, a time required for production per secondary formed workpiece is further shortened, which further improves the productivity of valves.

In accordance with the sixth aspect, because the secondary formed workpiece formed in the forging press main body is carried out quickly by the secondary formed workpiece carry-out/transfer device, to be transferred onto the heat treating furnace, the productivity of valves is reliably improved.

BRIEF DESCRIPTION OF THE DRAWINGS

FIG. 5A shows a state in which the discharging chuck goes forward, to wait at a position close to a workpiece in the process of primary formation, FIG. 5B shows a state in which the discharging chuck grips the primary formed workpiece immediately after the formation, FIG. 5C shows a state in which the discharging chuck gripping the primary formed workpiece goes back, and FIG. 5D shows a state in which the discharging chuck gripping the primary formed workpiece slides up to a predetermined position in the horizontal direction.

FIG. 7A is a front view of the arm, and FIG. 7B is a plan view of the arm.

BEST MODES FOR CARRYING OUT THE INVENTION

A first embodiment of a forging press device for valve according to the present invention will be described on the basis of the drawings.

Figure 1:
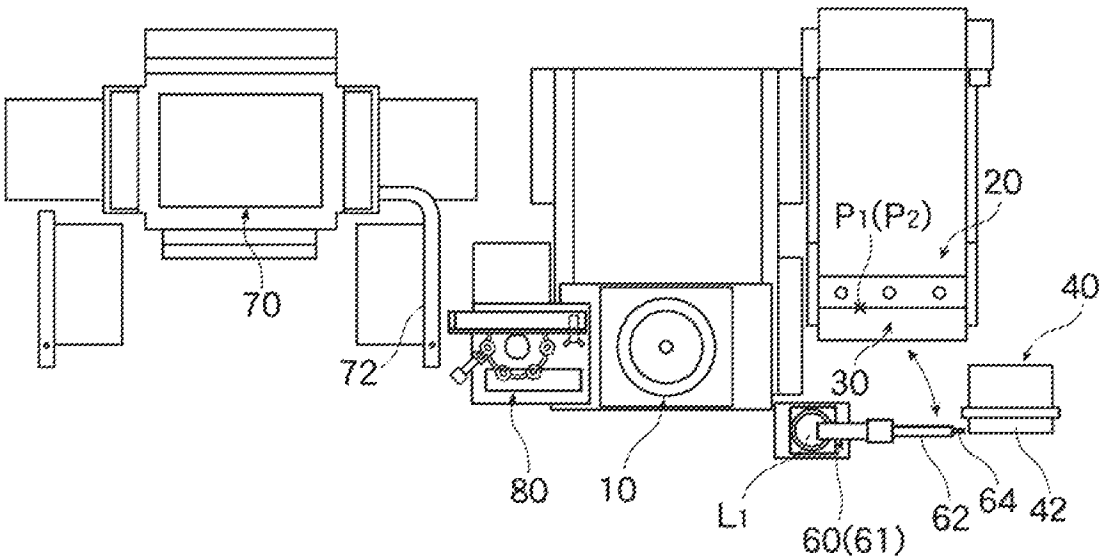
FIG. 1 is a plan view showing an entire configuration of a valve forging automation line to which a first embodiment of a forging press device for valve according to the present invention is applied.

FIGS. 1 to 9 are diagrams showing a valve forging automation line to which a forging press device for valve according to the first embodiment is applied. FIG. 1 shows a plan view of the entire valve forging automation line, and FIGS. 2 to 9 show the respective devices composing the forging press device for valve, for example, an upsetter 20 which primarily forms a workpiece W, a workpiece feed/discharge device 30 which discharges a primary formed workpiece from the upsetter 20, and feeds a new workpiece to the upsetter 20, a high speed multi-jointed robot 60 which conveys a primary formed workpiece W1 formed in the upsetter 20, to carry it into a forging press main body 10, a secondary formed workpiece carry-out/transfer device 80 which carries a secondary formed workpiece W2 out from the forging press main body 10, to transfer it onto a heat treating furnace 70, and the like.

In FIG. 1, reference symbol 10 denotes a forging press main body including a pair of upper and lower metallic molds 12 and 14 (refer to FIG. 9) for secondary formation, and the upsetter 20 is disposed adjacent to one side (on the right side of FIGS. 1 and 9) when the forging press main body 10 is viewed from the front, and further a bar material feed device 40 is disposed adjacent to the upsetter 20, that is, the respective devices from the forging press main body 10 to the bar material feed device 40 are approximately-linearly disposed. Further, the high speed multi-jointed robot 60 which conveys a primary formed workpiece W1 formed in the upsetter 20, to carry it into the forging press main body 10 is disposed between the forging press main body 10 and the upsetter 20.

On the other hand, the heat treating furnace 70 which performs heating treatment onto a secondary formed workpiece W2 is disposed on the opposite side (on the left side of FIGS. 1 and 9) when the forging press main body 10 is viewed from the front, and the secondary formed workpiece carry-out/transfer device 80 which carries the secondary formed workpiece W2 formed in the forging press main body 10 out, to transfer it onto a delivery conveyor 72 extending into the heat treating furnace 70 is disposed between the forging press main body 10 and the heat treating furnace 70.

Figure 2:
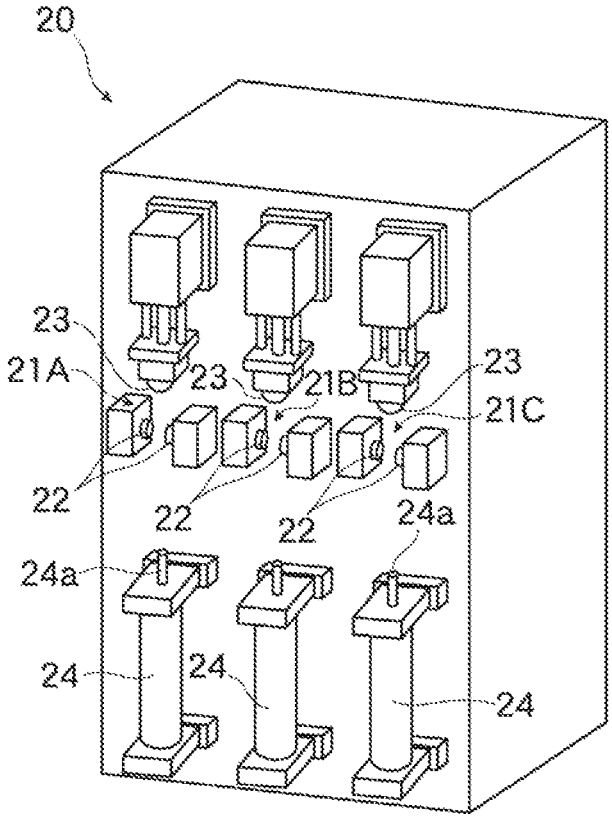
FIG. 2 is a perspective view of upsetters composing the forging press device for valve.

The upsetter 20 which primarily forms the workpiece W is a device which is configured to grip a round bar material serving as a workpiece W with an electrode, and apply electric current between the electrode and an end of the round bar material, to pressurize it from the other end, thereby bulging its heated end into a ball shape. To describe in detail, as shown in FIG. 2, forming stages 21A, 21B, and 21C which have pairs of right and left electrode chucks 22 and 22, anvil electrodes 23 above those, and pressurizing devices 24 under those are installed side by side in the horizontal direction on the front surface side of the upsetter 20, and a direct-current inverter heating system is adopted, thereby it is possible to primarily form three workpieces W at one time at high speed. In addition, reference symbols 24*a* are elevator rods of the pressurizing devices 24 supporting the workpieces W from underneath.

Figure 3:
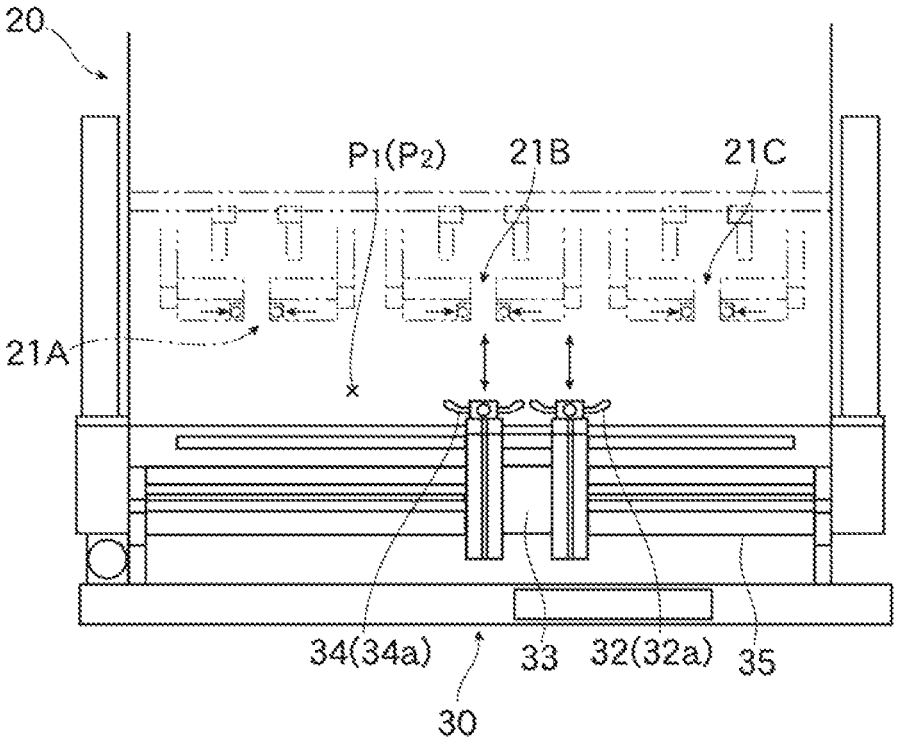
FIG. 3 is a plan view of a workpiece feed/discharge device which is installed along forming stages of the upsetter.
Figure 4:
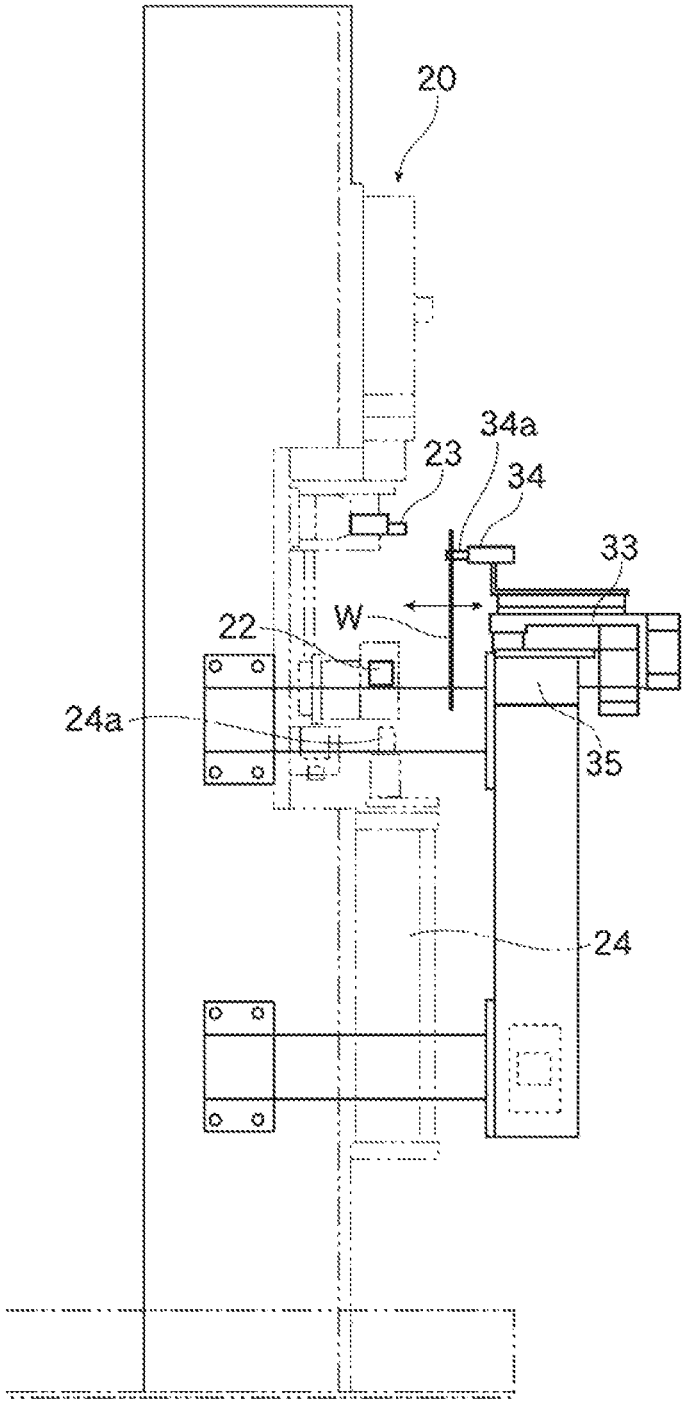
FIG. 4 is a side view of the workpiece feed/discharge device (the diagram viewed from the right of FIG. 3).
Figure 5:
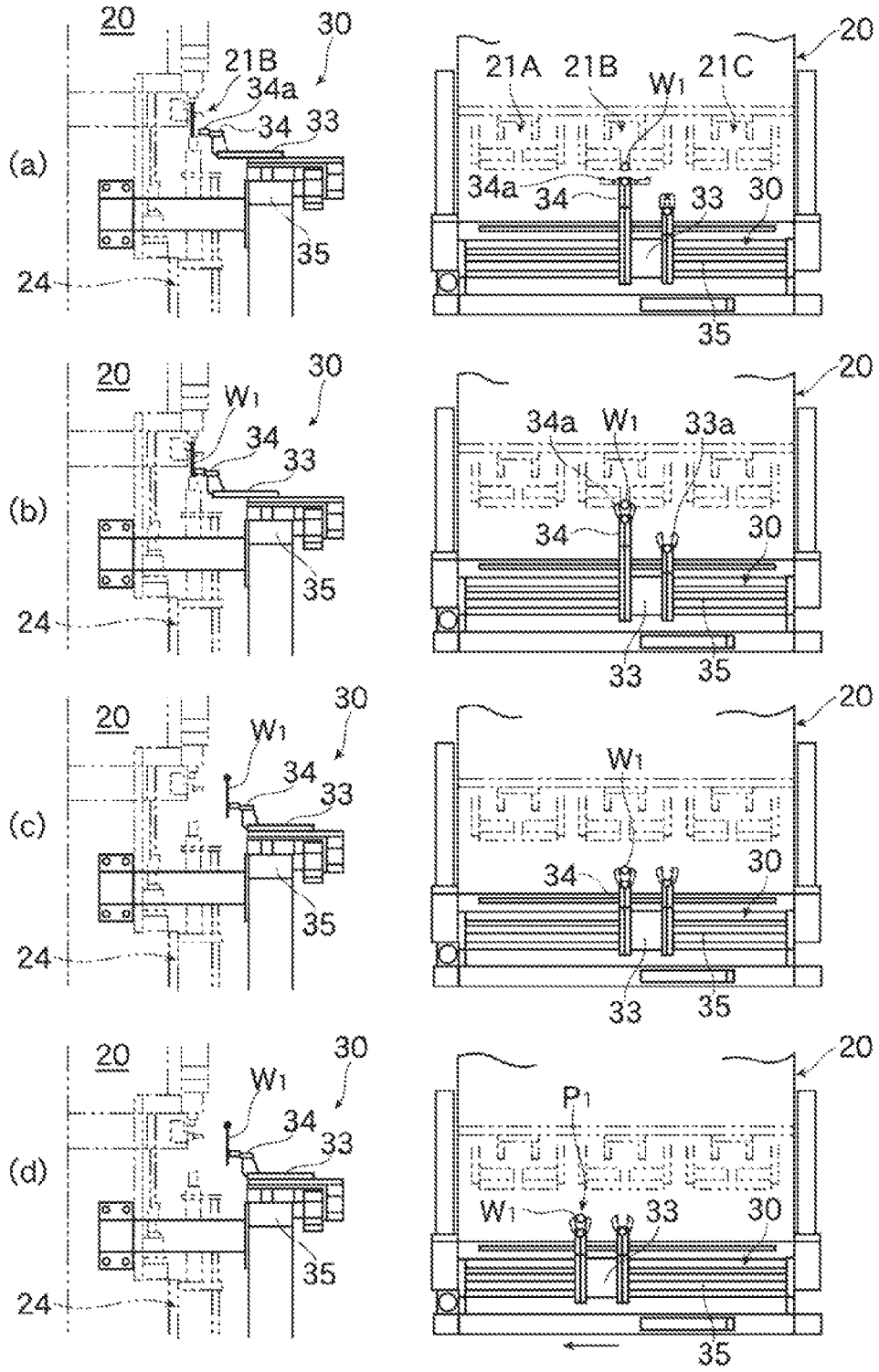
FIG. 5 are diagrams for explanation of a situation in which a workpiece discharging chuck of the workpiece feed/discharge device grips a primary formed workpiece, to discharge it up to a predetermined position (a delivering position to the arm of the high speed multi-jointed robot).

In front of the forming stages 21A, 21B, and 21C of the upsetter 20, as shown in FIGS. 3 and 4, there is installed the workpiece feed/discharge device 30 which includes a pair of right and left workpiece feeding chuck 32 and workpiece discharging chuck 34 which are respectively slidable in a front-back direction of approaching and departing from the forming stages 21A, 21B, and 21C of the upsetter 20, and in a horizontal direction which is the direction in which the forming stages 21A, 21B, and 21C of the upsetter 20 are installed side by side.

That is, on the front surface side of the upsetter 20, a linear slide 35 which is fixedly supported by the upsetter 20, so as to extend in the horizontal direction is installed, and a horizontal slider 33 is mounted on the linear slide 35 so as to be slidable in the horizontal direction, and the horizontal slider 33 is capable of sliding in the horizontal direction (the horizontal direction in FIG. 3) by motor-driving a ball screw (not shown) installed parallel to the linear slide 35. Further, the workpiece feeding chuck 32 and the workpiece discharging chuck 34 are mounted on the horizontal slider 33 so as to be slidable in a front-back direction (the vertical direction in FIG. 3, and the horizontal direction in FIG. 4) respectively via guided air cylinders (not shown).

Further, as shown in FIG. 3, pairs of claws 32*a* and 32*a*; 34*a* and 34*a* which are capable of opening up to 180 degrees, and close so as to be capable of reliably gripping the thin primary formed workpieces W are provided on the tip end sides of the respective chucks 32 and 34.

Then, the primary formed workpieces W1 formed at the forming stages 21A, 21B, and 21C are delivered to (the claws 34*a* of) the workpiece carrying-out chuck 34, and are discharged up to a predetermined position P1 (refer to FIG. 3) at which it is possible to deliver it to (claws 64*a* of) a chuck 64 provided on the tip end side of an arm 62 of the high speed multi-jointed robot 60, to be delivered to (the claws 64*a* of) the chuck 64 on the tip end side of the arm 62 of the robot 60, and are conveyed/carried into the forging press main body 10 by the robot 60.

On the other hand, the workpiece feeding chuck 32 is configured, as will be described later, to deliver a workpiece W via the high speed multi-jointed robot 60 at a predetermined workpiece delivering position P2 (the same position as the workpiece delivering position P1 to the robot 60 of the primary formed workpieces W1), and (the claws 32*a* of) the workpiece feeding chuck 32 gripping the workpiece W feeds workpieces W to the forming stages 21A, 21B, and 21C.

Figure 6:
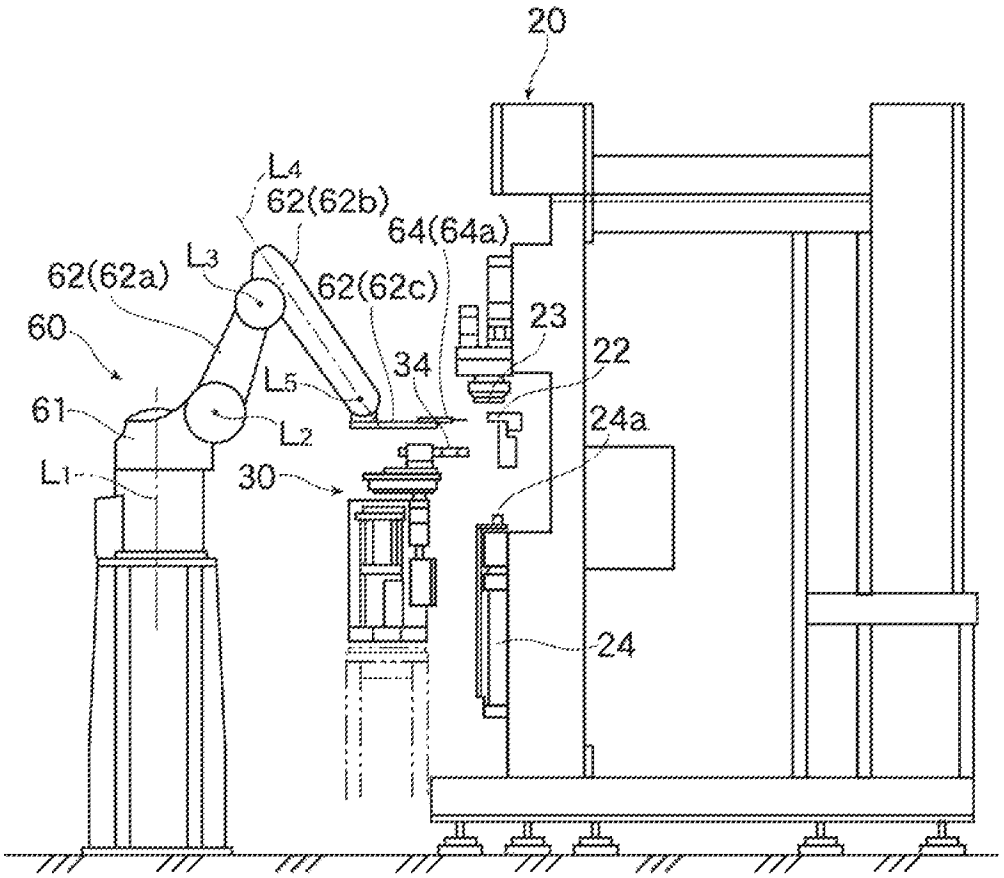
FIG. 6 is a diagram showing a high speed multi-jointed robot which conveys a primary formed workpiece, to carry it into the forging press main body (a diagram viewed from the right shown in FIG. 1).
Figure 7:
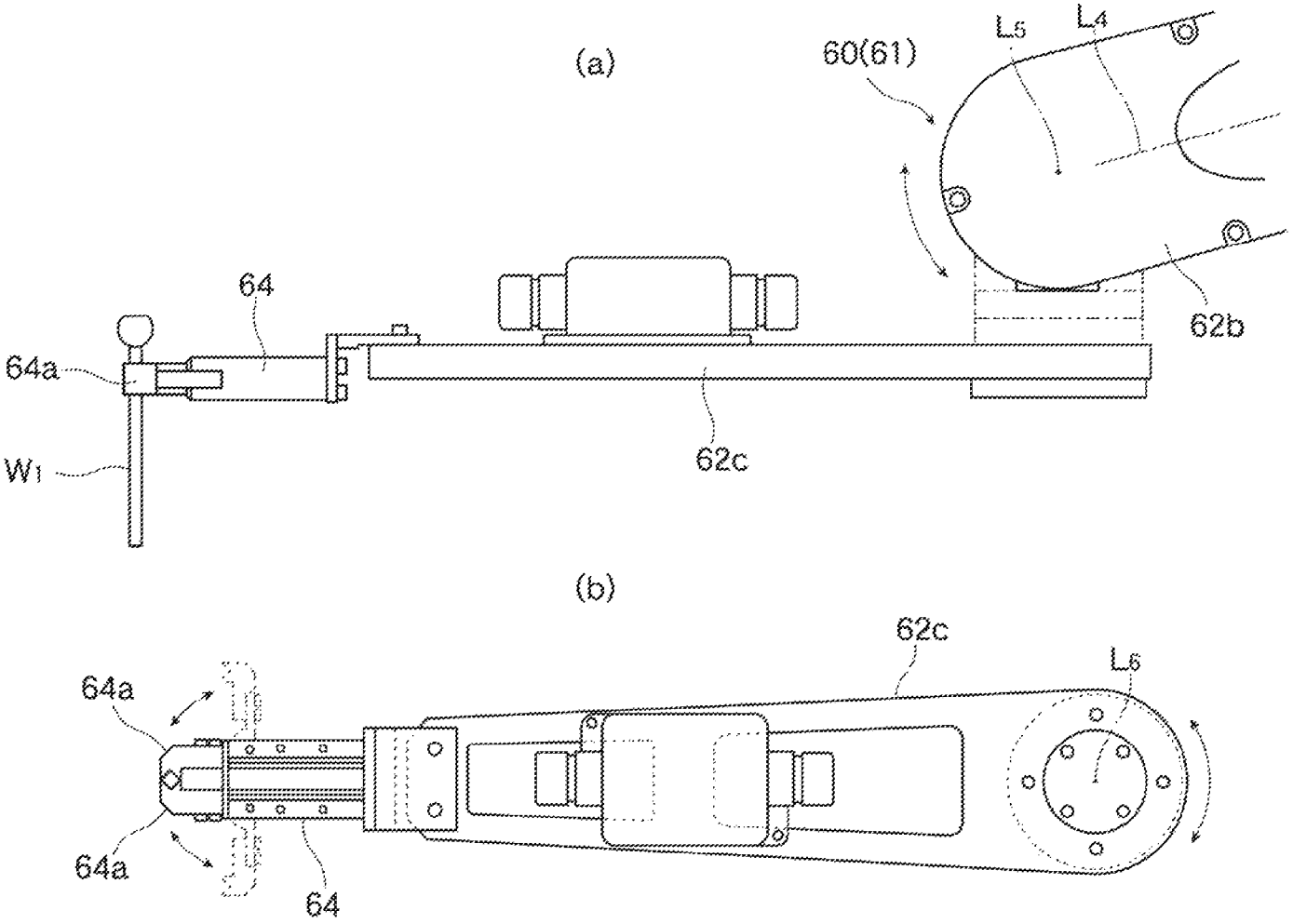
FIG. 7 are enlarged views of an arm of the high speed multi-jointed robot.

That is, the high speed multi-jointed robot 60 has a structure that a robot main body 61 is capable of circling around a vertical spindle L1 as shown in FIGS. 1 and 6, and the chuck 64 having the pair of claws 64*a* and 64*a* which has the same structure as the claws 32*a* and 34*a* of the chucks 32 and 34 of the workpiece feed/discharge device 30 is provided on the tip end side of the arm 62 of the robot main body 61 as shown in FIG. 7, and the claws 64*a* of the chuck 64 are capable of opening up to 180 degrees, and close so as to be capable of reliably gripping the thin workpiece W.

The substantially L-shaped arm 62 (62*a*, 62*b*, 62*c*) of the high speed multi-jointed robot 60 has a structure which is capable of turning around six axes (L1 to L6) as shown in FIGS. 6 and 7. To describe in detail, the rear end side arm 62*a* is capable of turning around a horizontal spindle L2 with respect to the robot main body 61. The front end side arm 62*b* is capable of turning around a horizontal spindle L3 between the rear end side arm 62*a* and a spindle L4 along the central shaft of the arm 62*a* respectively, and the most front end arm 62*c* is capable of turning around a horizontal spindle L5 on the front end side of the arm 62*b* and a vertical spindle L6 on the rear end side of the arm 62*c*.

Further, the chuck 64 of the arm 62 of the high speed multi-jointed robot 60 does not reach the three forming stages 21A, 21B, and 21C of the upsetter 20 as shown in FIG. 1. However, it goes without saying that the chuck 64 reaches the workpiece delivering position P1 (P2), and is configured to reach the bar material feeding route 42 (refer to FIG. 1) of the bar material feed device 40.

Then, the workpiece W is, held in an upright form one by one on the bar material feeding route 42 of the bar material feed device 40. However, as shown in FIG. 1, (the claws 64*a* and 64*a* of) the chuck 64 at the tip end of the arm 62 of the high speed multi-jointed robot 60 grips the workpiece W on the bar material feeding route 42, to convey it to the predetermined workpiece delivering position P2, so as to deliver it to (the claws 32*a* and 32*a* of) the workpiece feeding chuck 32 of the workpiece feed/discharge device 30.

Next, with reference to FIGS. 5A to 5D, the situation in which a primary formed workpieces W1 formed in the upsetter 20 is carried out up to the predetermined position P1 by the workpiece discharging chuck 34 of the workpiece feed/discharge device 30 will be described in detail.

In general, primary formation by the upsetter 20 takes time severalfold more than a time for secondary formation (forging pressing) by the forging press main body 10. For example, secondary formation is completed in several seconds, and on the other hand, primary formation takes time severalfold more than that time. For that reason, in the present embodiment, for example, the formations at the respective forming stages 21A, 21B, and 21C are set so as to be completed at intervals of approximately ⅓ of a time required for primary formation per workpiece W, and the interval at which the formations at the respective forming stages 21A, 21B, and 21C are completed and the interval for secondary formation (forging pressing) by the forging press main body 10 are set so as to match one another.

That is, as shown in FIG. 5A, in time for a timing in which a formation at the forming stage 21B located in the center in the horizontal direction is completed, the horizontal slider 33 slides to be at a position at which the workpiece discharging chuck 34 is directly opposed to the forming stage 21B, and the workpiece discharging chuck 34 goes forward to wait at a position close to the forming stage 21B. Then, at the same time of the completion of the formation of the workpiece at the forming stage 21B, as shown in FIG. 5B, the workpiece discharging chuck 34 grips the primary formed workpiece W1 on the forming stage 21B, and at the same time, gripping of the workpiece W1 by the electrode chucks 22 and 22 and the electrode 23, and (the elevator rod 24*a* of) the pressurizing device 24 is released. Then, the discharging chuck 34 gripping the primary formed workpiece W1 goes back from the forming stage 21B as shown in FIG. 5C, and the horizontal slider 33 slides a given distance in the horizontal direction as shown in FIG. 5D, and the discharging chuck 34 (the primary formed workpiece W1) is brought to the delivering position P1 to the chuck 64 of the high speed multi-jointed robot 60.

In addition, a new workpiece W is already delivered to the workpiece feeding chuck 32 which is adjacent to the discharging chuck 34, to wait in the vicinity of the forming stage 21B, by the high speed multi-jointed robot 60 while primarily forming the workpiece W at the forming stage 21B. That is, in a state in which the workpiece discharging chuck 34 goes back before the state shown in FIG. 5A, the new workpiece W is delivered to the workpiece feeding chuck 32 via (the chuck 64 of) the high speed multi-jointed robot 60 at the predetermined workpiece delivering position P2 at which the horizontal slider 33 moves a given distance in the horizontal direction.

Therefore, at the same time of the completion of the delivery of the primary formed workpiece W1 to (the chuck 64 of) the high speed multi-jointed robot 60 at the predetermined workpiece delivering position P1, the horizontal slider 33 slides in the horizontal direction to be at a position at which the workpiece feeding chuck 32 gripping the new workpiece W is directly opposed to the forming stage 21B, and the workpiece feeding chuck 32 goes forward to feed the new workpiece W to the forming stage 21B.

When the feeding of the new workpiece W to the vacant forming stage 21B is completed, the workpiece feeding chuck 32 goes back, and the horizontal slider 33 (the chucks 32 and 34) slides up to the predetermined workpiece delivering position P2, to deliver the new workpiece W to the workpiece feeding chuck 32 by the high speed multi-jointed robot 60.

Next, the horizontal slider 33 (the chucks 32 and 34) slides up to a position of a predetermined forming stage at which a primary formation is completed following that at the forming stage 21B, and the workpiece discharging chuck 34 goes forward, to wait at a position close to the predetermined forming stage.

Then, by repeating this operation, it is possible to continuously convey/carry the primary formed workpieces W1 formed at the forming stages 21A, 21B, and 21C into the forging press main body 10 at a timing of pressing (secondary formation) of the forging press main body 10 by the workpiece feed/discharge device 30 and the high speed multi-jointed robot 60.

In this way, in the present embodiment, the primary formed workpiece W1 formed, for example, at the forming stage 21B of the upsetter 20 is carried out up to the predetermined position P1 via the workpiece feed/discharge device 30, and is conveyed/carried into the forging press main body 10 via the high speed multi-jointed robot 60. Meanwhile, the number of deliveries of workpiece while a workpiece is carried into the forging press main body 10 is three of the forming stage 21B→the workpiece feed/discharge device 30 (the discharging chuck 34)→the chuck 64 of the high speed multi-jointed robot 60→the forging press main body 10, that is decreased one as compared with that of the conventional forging press device which performs four deliveries of workpiece, thereby shortening a conveyance/carry-in time of the primary formed workpiece W1 formed in the upsetter 20 to the forging press main body 10.

As a result, a time required for production per secondary formed workpiece is shortened, which improves the productivity of valves.

Further, the secondary formed workpiece W2 secondarily-formed in the forging press main body 10 is carried out laterally to the forging press main body 10 by the secondary formed workpiece carry-out/transfer device 80 which operates at a timing of opening and closing the metallic molds 12 and 14 of the forging press main body 10, to be transferred onto the delivery conveyor 72 extending to the heat treating furnace 70.

The heat treating furnace 70 adjacent to the forging press main body 10 is, for example, a furnace for performing annealing treatment for eliminating strain remaining in the forged secondary formed workpiece W2, and performs heat treating such that the secondary formed workpiece W2 formed in the forging press main body 10 is placed on the delivery conveyor 72, and is conveyed slowly over time (for example, 30 minutes) inside the furnace 70 kept at 500 degrees or more, for example.

Figure 8:
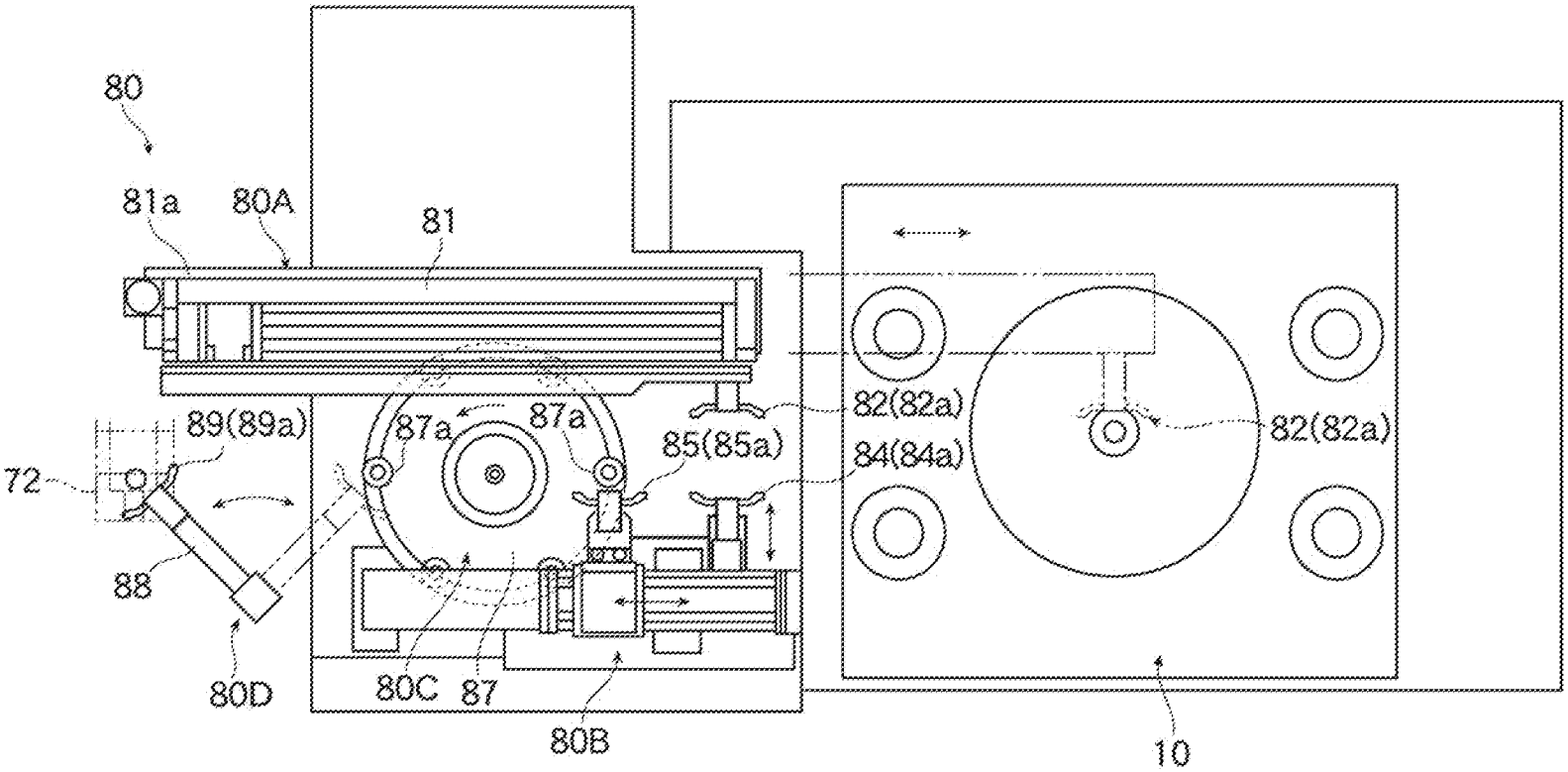
FIG. 8 is a plan view of a secondary formed workpiece carry-out/transfer device which carries a secondary formed workpiece out from the forging press main body.
Figure 9:
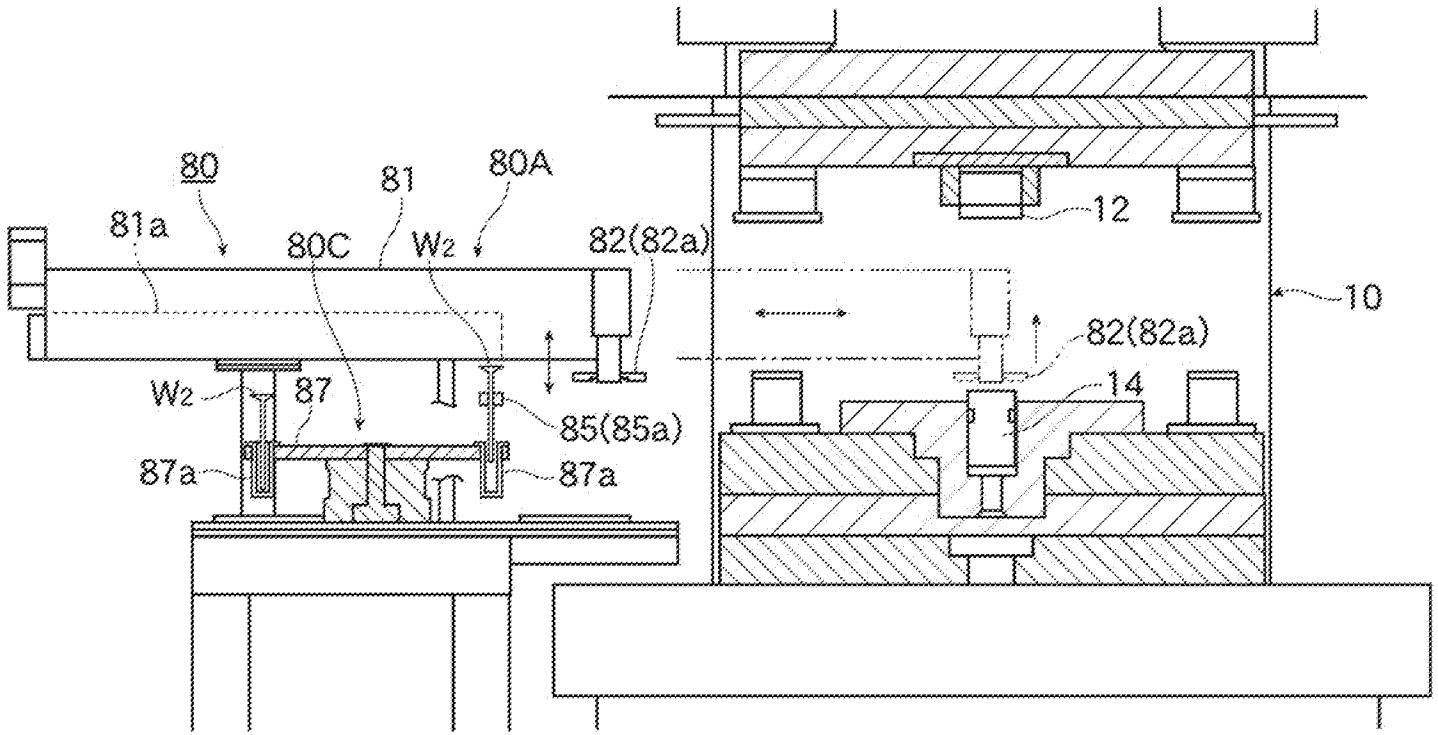
FIG. 9 is a front view showing a part of the secondary formed workpiece carry-out/transfer device in section.

The secondary formed workpiece carry-out/transfer device 80 is composed of, as shown in FIGS. 8 and 9, a first carry-out mechanism 80A in which a first chuck 82 grips a secondary formed workpiece W2 formed in the forging press main body 10, to carry it out laterally to the forging press main body 10 (in the left direction in FIGS. 8 and 9), a second carry-out mechanism 80B which is installed parallel to the first carry-out mechanism 80A, and includes upper and lower two-stage second and third chucks 84 and 85 which sequentially deliver the secondary formed workpiece W2 delivered by the first chuck 82, a conveyor mechanism 80C which is installed on the lower side between the first carry-out mechanism 80A and the second carry-out mechanism 80B, and has a rotary table 87 in which workpiece housing pots 87*a* whose upper sides are open are provided at six places equally circumferentially, and which rotates 180 degrees while housing a secondary formed workpiece W2 delivered by the third chuck 85 into the pot 87*a*, to convey the workpiece W2 to a predetermined position, and a swing arm system workpiece transfer mechanism 80D which has a fourth chuck 89 gripping a secondary formed workpiece W2 at the tip end of its arm 88, and grips the secondary formed workpiece W2 delivered by the conveyor mechanism 80C, to transfer it onto the delivery conveyor 72 of the heat treating furnace 70.

In addition, the first chuck 82, the second chuck 84, the third chuck 85, and the fourth chuck 89 have claws 82*a*, 84*a*, 85*a*, and 89*a* having the same structure of the pair of claws 32*a* and 32*a* (34*a* and 34*a*) provided at the chuck 32 (34) of the workpiece feed/discharge device 30.

To describe in detail, in the first carry-out mechanism 80A, as shown by the virtual lines in FIGS. 8 and 9, a horizontal slider 81 is mounted on a base 81*a* extending in the horizontal direction so as to be slidable in the horizontal direction, and the first chuck 82 is provided so as to be capable of an elevating operation on the front surface side of the tip end of the horizontal slider 81. Therefore, as shown by the virtual lines in FIGS. 8 and 9, the first chuck 82 grips (the shaft portion of) the secondary formed workpiece W2 which is knocked out, to project upward from the lower metallic mold 14 at a position close to the lower metallic mold 14, and goes up a given distance, thereby extracting the workpiece W2 from the lower metallic mold 14. Then, (the shaft portion of) the secondary formed workpiece W2 gripped by (the claws 82*a* of) the first chuck 82 slides laterally to the forging press main body 10 (to the left side in FIGS. 8 and 9) by the horizontal slider 81, to be at a position directly opposed to the second chuck 84 at the lower stage of the second carry-out mechanism 80B.

The second chuck 84 is slidable only in the front-back direction (the vertical direction of FIG. 8), and the second chuck 84 in a state of going forward (being close to the first chuck 82 of the first carry-out mechanism 80A) receives the secondary formed workpiece W2 from the first chuck 82, to return to the original position.

On the other hand, the upper stage third chuck 85 of the second carry-out mechanism 80B is provided so as to be right-and-left slidable and up-and-down slidable, and moves to right above the second chuck 84 receiving the workpiece W2 (slides to the right side of FIG. 8), to receive the secondary formed workpiece W2 from the second chuck 84, and further moves to right above a given workpiece housing pot 87*a* of the rotary table 87 of the conveyor mechanism 80C, and thereafter, goes down to insert (the shaft portion of) the secondary formed workpiece W2 into the workpiece housing pot 87*a*, thereby delivering the secondary formed workpiece W2 to the conveyor mechanism 80C.

Then, at a position at which the rotary table 87 of the conveyor mechanism 80C rotates by 180 degrees, in a state in which (the claws 89*a* of) the fourth chuck 89 at the tip end of the arm 88 of the swing arm system transfer mechanism 80D grips the secondary formed workpiece W2 housed in the workpiece housing pot 87*a* of the rotary table 87, the arm 88 goes up by a given distance, and thereafter swings horizontally only by a given angle, to release gripping of the workpiece W2 by the fourth chuck 89, thereby transferring the secondary formed workpiece W2 onto the delivery conveyor 72 extending to the heat treating furnace 70.

In addition, the rotary table 87 of the conveyor mechanism 80C is a mechanism for delivering the secondary formed workpiece W2 received from the third chuck 85 of the second carry-out mechanism 80B to the swing arm system transfer mechanism 80D. Because the rotary table 87 intermittently rotates at every 180 degrees, to receive the workpiece W2 from the second carry-out mechanism 80B and deliver the workpiece W2 to the swing arm system transfer mechanism 80D simultaneously, the workpiece housing pots 87*a* may be provided at least at two places equally circumferentially.

However, the workpiece housing pots 87*a* are provided at six places equally circumferentially, which makes it possible to simultaneously house that many secondary formed workpieces W2.

That is, in the case where any one of the devices composing the valve manufacturing line on the downstream side of the conveyor mechanism 80C is stopped, it is necessary to stop the valve manufacturing line. However, if the line is stopped, workpieces in the process of primary formation in the upsetter 20 go to waste. Then, the present embodiment is configured such that the workpiece housing pots 87*a* are provided at six places equally circumferentially in the rotary table 87, thereby not immediately stopping the line from the upsetter 20 to the forging press main body 10, and at least after all the three workpieces in the process of primary formation in the upsetter 20 are secondarily formed in the forging press main body 10, and are housed in the rotary table 87 of the conveyor mechanism 80C, the entire line is stopped, thereby not wasting the workpieces.

Figure 10:
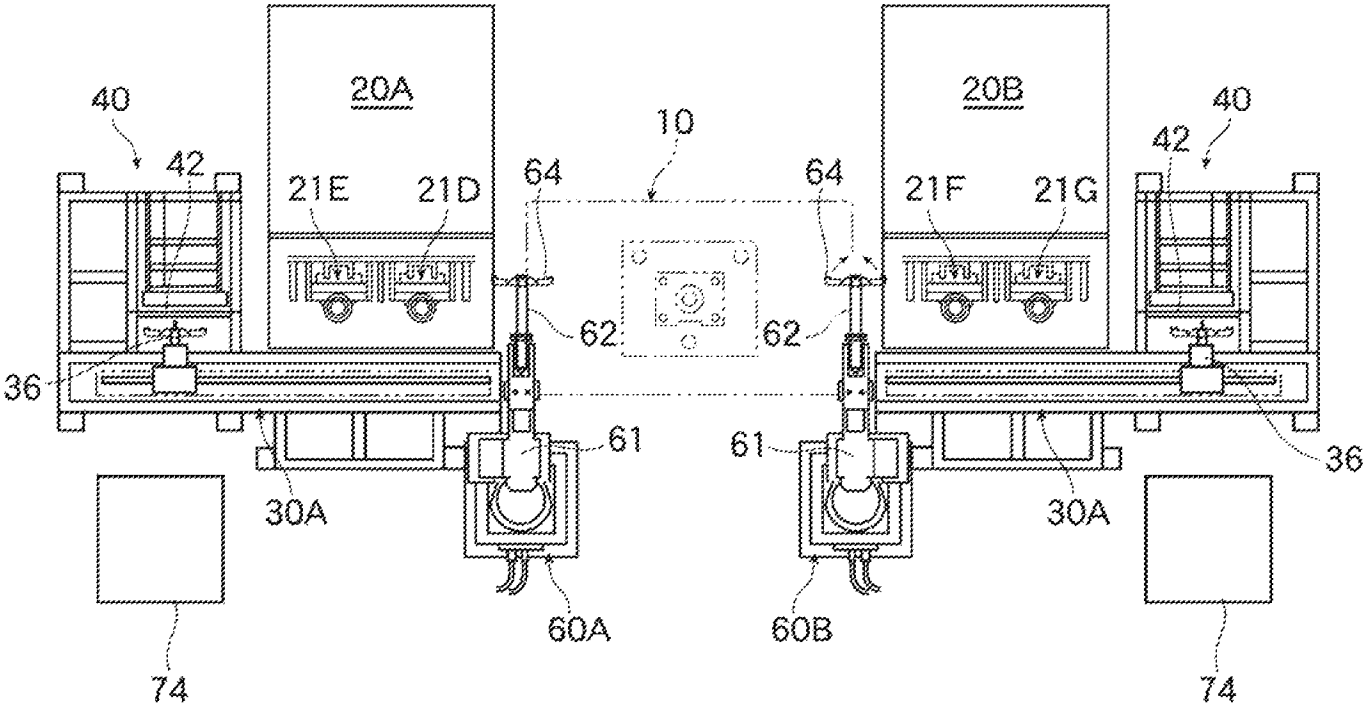
FIG. 10 is a plan view showing an entire configuration of a valve forging automation line to which a second embodiment of the forging press device for valve according to the present invention is applied.

FIG. 10 is a plan view of a main part of a valve forging automation line to which a second embodiment of the forging press device for valve according to the present invention is applied.

Upsetters 20A (20B) are disposed adjacent to the right and left both sides of the forging press main body 10, and the bar material feed devices 40 are further disposed adjacent to the upsetters 20A (20B), and the forging press device for valve is disposed substantially linearly across the forging press main body 10.

Workpiece feed devices 30A including workpiece feeding chucks 36 are installed on the front surface sides from the upsetters 20A and 20B to the bar material feed devices 40 and 40, and (the claws 36*a* at the tips of) the chucks 36 grip workpieces W on the workpiece feeding routes 42 of the bar material feed devices 40, to feed those to the vacant forming stages of the upsetters 20A (20B). The workpiece feeding chucks 36 have the same structure as the workpiece feeding chuck 32 of the workpiece feed/discharge device 30 in the first embodiment mentioned above, and overlapping description thereof will be omitted.

Further, between the upsetters 20A (20B) and the forging press main body 10, high speed multi-jointed robots 60A (60B) which convey primary formed workpieces W1 formed at forming stages 21D and 21E (21F and 21G) of the upsetter 20A (20B), to carry those into the forging press main body 10 are disposed.

Further, secondary formed workpiece collecting units 74 are respectively provided on the opposite sides across the workpiece feed devices 30A of the upsetters 20A (20B), (The claw 64*a* of) the chuck 64 provided on the tip end side of the arm 62 of the high speed multi-jointed robot 60A (60B) transfers a secondary formed workpiece W2 formed in the forging press main body 10 onto the secondary formed workpiece collecting units 74. The secondary formed workpieces W2 collected in the secondary formed workpiece collecting units 74 are carried into a batch-type heat treating furnace (not shown) by a worker for example, at the stage at which the secondary formed workpieces W2 are cooled down after a predetermined time elapsed.

Hereinafter, the configuration of the second embodiment different from the first embodiment will be described.

First, the forming stages 21D and 21E; 21F and 21G at two places are installed side by side in the upsetters 20A and 20B, which are respectively capable of primarily forming two workpieces W simultaneously. Then, in the present embodiment, the formations at the respective forming stages 21D and 21E; 21F and 21G are set so as to be sequentially completed at intervals of approximately ¼ of a time required for primary formation per workpiece W, and the interval (timing) at which formations at the respective forming stages 21D and 21E; 21F and 21G are completed and the interval (timing) for secondary formation (forging pressing) by the forging press main body 10 are set so as to match one another.

Second, the two chucks 32 and 34 sharing roles such that the workpiece discharging chuck 34 grips a primary formed workpiece W1 on a forming stage, to carry it out, and the workpiece feeding chuck 32 feeds a new workpiece W to a vacant forming stage, are provided in the workpiece feed/discharge device 30. On the other hand, the present embodiment is configured such that the workpiece feeding chuck 36 provided in the workpiece feed device 30A performs only a feeding operation of a new workpiece W to a vacant forming stage.

That is, the workpiece feeding chuck 36 is configured to be slidable in the horizontal direction and the front-back direction with respect to the upsetter 20A in the same way as the chucks 32 and 34 of the workpiece feed/discharge device 30 of the first embodiment mentioned above, and the chuck 36 grips a workpiece W on the bar material feeding route 42 of the bar material feed device 40, to feed it to the forming stages 21D and 21E; 21F and 21G of the upsetter 20A.

Third, the high speed multi-jointed robots 60A and 60B which convey the primary formed workpieces W1 formed in the upsetters 20A and 20B, to carry those into the forging press main body 10 have the movable ranges of their arms 62 broader than that of the high speed multi-jointed robot 60 adopted in the first embodiment, and have the function of transferring the secondary formed workpieces W2 formed in the forging press main body 10 onto the secondary formed workpiece collecting units 74 and 74 as well.

That is, in the first embodiment mentioned above, because the movable range of the arm 62 of the high speed multi-jointed robot 60 is narrow, and the arm 62 does not reach the forming stages of the upsetter 20, (the discharging chuck 32 of) the workpiece feed/discharge device 30 discharges a primary formed workpiece W1 completed to be formed at the forming stage to the position P1 which the arm 62 of the high speed multi-jointed robot 60 reaches, to deliver it to the chuck 64 of the robot 60. Meanwhile, the second embodiment is configured such that the movable range of the arm 62 of the high speed multi-jointed robot 60 is broad, and the chuck 64 of the high speed multi-jointed robot 60A (60B) directly receives the primary formed workpieces W1 on the forming stages 21D and 21E; 21F and 21G, to convey/carry those into the forging press main body 10.

Therefore, in the present embodiment, the number of deliveries of workpiece while a primary formed workpiece W1 formed at a forming stage 21D of the upsetter 20A is carried into the forging press main body 10 is only two of the forming stage 21D→the chuck 64 of the high speed multi-jointed robot 60A→the forging press main body 10, that is further one less than that of the first embodiment in which the number of deliveries of workpiece is three, thereby further shortening a time required for conveying/carrying the primary formed workpiece W1 formed in the upsetter 20A (20B) into the forging press main body 10.

Fourth, this second embodiment is configured such that the upsetters 20A (20B), the workpiece feed devices 30A, and the high speed multi-jointed robots 60A (60B) are disposed on the both sides of the forging press main body 10, and primary formed workpieces are alternately and continuously conveyed/carried into the forging press main body 10 from the right and left both sides of the forging press main body 10.

Therefore, in this second embodiment, because the chucks 64 and 64 of the pair of the high speed multi-jointed robots 60A and 60B grip primary formed workpieces W1 formed in the upsetters 20A and 20B respectively corresponding thereto, to alternately and continuously convey/carry those into the forging press main body 10 from the right and left both sides of the forging press main body 10, it is possible to more quickly convey/carry the primary formed workpieces W1 into the forging press main body 10 more than the first embodiment.

Then, at the forming stages 21D and 21E; 21F and 21G of the upsetters 20A and 20B, primary formations are set so as to be completed in the order of, for example, 21D, 21F, 21E and 21G, and the high speed multi-jointed robots 60A and 60B alternately carry the primary formed workpieces W1 into the forging press main body 10 at timings of secondary formations (forging pressing) by the forging press main body 10.

Figure 11:
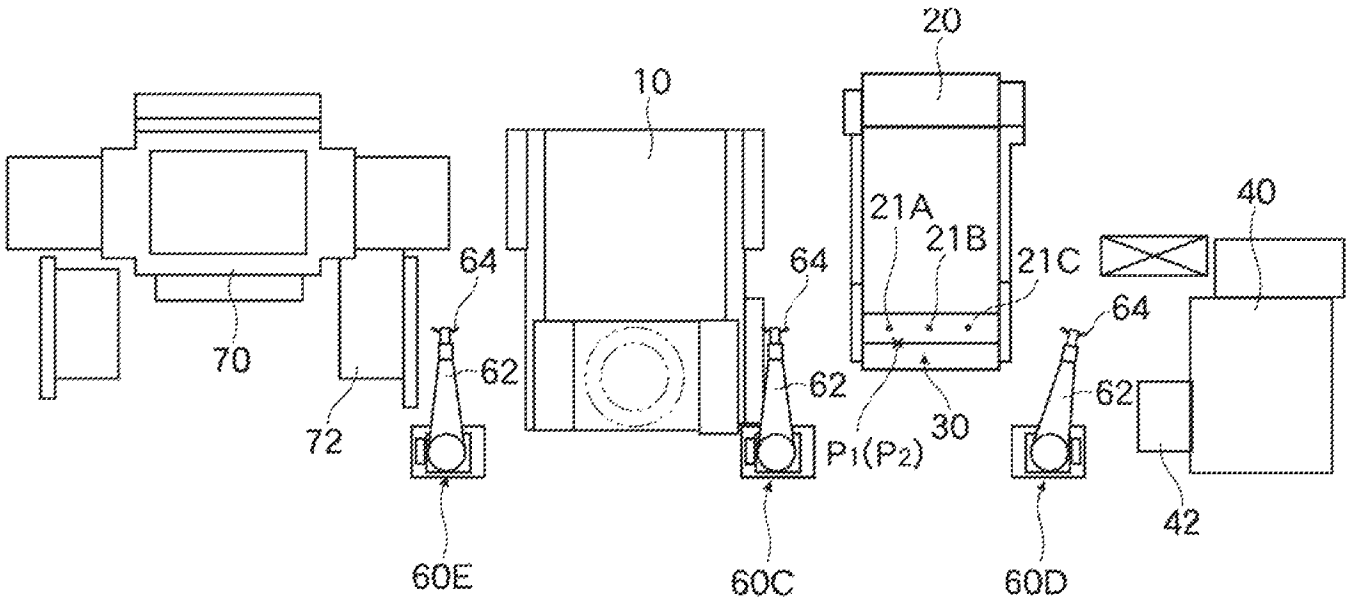
FIG. 11 is a plan view showing an entire configuration of a valve forging automation line to which a third embodiment of the forging press device for valve according to the present invention is applied.

FIG. 11 is a plan view of a main part of the valve forging automation line to which a third embodiment of the forging press device for valve according to the present invention is applied.

(The chuck 64 provided on the tip end side of) the arm 62 of the high speed multi-jointed robot 60 in the first embodiment mentioned above does not reach the respective forming stages 21A to 21C of the upsetter 20, but it goes without saying that the arm 62 reaches the predetermined positions (the workpiece delivering positions P1 and P2) in the vicinity of the forming stage 21A, and the arm 62 has the movable range of reaching the bar material feeding route 42 of the bar material feed device 40, thereby having the function of gripping a workpiece W on the bar material feeding route 42, to deliver it to the workpiece feeding chuck 32 of the workpiece feed/discharge device 30 as well.

On the other hand, (the chuck 64 provided on the tip end side of) the arm 62 of a high speed multi-jointed robot 60C in this third embodiment has a narrower movable range of (the chuck 64 provided on the tip end side of) the arm 62 as compared with that of the high speed multi-jointed robot 60 in the first embodiment, and therefore, the arm 62 does not reach the bar material feeding route 42 of the bar material feed device 40. Therefore, in this third embodiment, a high speed multi-jointed robot 60D which is similar to the robot 60C is disposed between the bar material feeding route 42 of the bar material feed device 40 and the upsetter 20, and (the chuck 64 of) the arm 62 of the robot 60D grips a workpiece W on the bar material feeding route 42, to deliver it to the workpiece feeding chuck 32 (not shown) of the workpiece feed/discharge device 30.

Further, in the present embodiment, the secondary formed workpiece carry-out/transfer device which transfers a workpiece W onto the delivery conveyor 72 which is a conveying route extending to the heat treating furnace 70 is composed of a high speed multi-jointed robot 60E which is similar to the high speed multi-jointed robot 60C in place of the secondary formed workpiece carry-out/transfer device 80 having a complicated structure adopted in the first embodiment.

The other parts are the same as the structures of the forging press devices of the first and second embodiments, and are denoted by the same reference symbols, and overlapping description thereof will be omitted.

Further, in the first to third embodiments mentioned above, the upsetters 20 and 20A (20B) in which the forming stages are installed side by side on their front surfaces are adopted. However, it may be a structure in which a plurality of upsetters (the conventionally known upsetters) in which a forming stage is provided only at one place on its front surface are disposed adjacent to one another as disclosed in the prior Patent Document 1.

REFERENCE SIGNS LIST

W . . . Workpiece (round bar material)
W1 . . . Primary formed workpiece
W2 . . . Secondary formed workpiece
10 . . . Forging press main body
12 . . . Metallic mold of forging press main body
20, 20A . . . Upsetter
21A, 21B, 21C, 21D, 21E . . . Forming stage
30 . . . Workpiece feed/discharge device
30A . . . Workpiece feed device
32 . . . Workpiece feeding chuck
32*a*, 34*a*, 35*a*, 36*a* . . . Claws for gripping workpiece
34 . . . Workpiece discharging chuck
36 . . . Workpiece feeding chuck
40 . . . Bar material feed device
42 . . . Bar material feeding route
60, 60A, 60B . . . High speed multi-jointed robot serving as primary formed workpiece conveyance/carry-in device
62 . . . Arm of high speed multi-jointed robot
64 . . . Chuck provided on tip end side of arm
64*a* . . . Claws for gripping workpiece
L1 . . . Vertical rotary spindle of high speed multi-jointed robot
70 . . . Heat treating furnace
72 . . . Delivery conveyor
80 . . . Secondary formed workpiece carry-out/transfer device

The invention claimed is:

1. A forging system for forging a valve, comprising:

at least one upsetter comprising a forming stage provided at a front surface thereof, the forming stage comprising an electrode, a pair of electrode chucks, and a pressurizing device mounted on the front surface, the pair of electrode chucks gripping a round bar material, an electric current being provided between the electrode and a first end of the round bar material, and the round bar material being pressurized by the pressurizing device from a second end of the round bar material, thereby forming a primary formed workpiece having the first end thereof bulged into a ball shape;

a workpiece feed/carry-out device which is installed on the front surface side of the upsetter, that feeds the round bar material to the forming stage and carries the primary formed workpiece out from the forming stage;

a forging press main body which is disposed adjacent laterally to the upsetter, the forging press main body receiving the primary formed workpiece formed in the upsetter and forming a secondary formed workpiece with upper and lower metallic molds;

a primary formed workpiece conveyance/carry-in device which is disposed in the vicinity of the upsetter and the forging press main body, that grips and conveys the primary formed workpiece formed in the upsetter, to carry the primary formed workpiece from the workpiece feed/carry-out device into the forging press main body; and a round bar material feed device which is disposed adjacent laterally on the opposite side of the upsetter relative to the forging press main body, wherein the workpiece feed/carry-out device includes a workpiece discharging chuck and a workpiece feeding chuck which integrally slide in a horizontal direction with respect to the upsetter, and respectively slide independently in a front-back direction of approaching and departing from the upsetter, wherein the primary formed workpiece conveyance/carry-in device is composed of a high speed multi jointed robot having an arm and a vertical rotary spindle, the arm being capable of circling around the vertical rotary spindle, the arm gripping the primary formed workpiece on the front surface side of the upsetter with a chuck provided at a tip end of the arm, and wherein the high speed multi jointed robot receives the round bar material on a bar material feeding route of the round bar material feed device, to deliver the round bar material to the workpiece feeding chuck of the workpiece feed/carry-out device, and receives the primary formed workpiece from the workpiece discharging chuck of the workpiece feed/carry-out device, to convey/carry the primary formed workpiece into the forging press main body.

2. A forging system for forging a valve, comprising:

at least one upsetter comprising a forming stage provided at a front surface thereof, the forming stage comprising an electrode, a pair of electrode chucks, and a pressurizing device mounted on the front surface, the pair of electrode chucks gripping a round bar material, an electric current being provided between the electrode and a first end of the round bar material, and the round bar material being pressurized by the pressurizing device from a second end of the round bar material, thereby forming a primary formed workpiece having the first end thereof bulged into a ball shape;

a workpiece feed/carry-out device which is installed on the front surface side of the upsetter, that feeds the round bar material to the forming stage and carries the primary formed workpiece out from the forming stage;

a forging press main body which is disposed adjacent laterally to the upsetter, the forging press main body receiving the primary formed workpiece formed in the upsetter and forming a secondary formed workpiece with upper and lower metallic molds;

a primary formed workpiece conveyance/carry-in device which is disposed in the vicinity of the upsetter and the forging press main body, that grips and conveys the primary formed workpiece formed in the upsetter, to carry the primary formed workpiece from the workpiece feed/carry-out device into the forging press main body; and a round bar material feed device which is disposed adjacent laterally on the opposite side of the upsetter relative to the forging press main body, wherein the workpiece feed/carry-out device includes a workpiece discharging chuck and a workpiece feeding chuck which integrally slide in a horizontal direction with respect to the upsetter, and respectively slide independently in a front-back direction of approaching and departing from the upsetter, wherein the primary formed workpiece conveyance/carry-in device comprises a first high speed multi jointed robot having an arm and a vertical rotary spindle, the arm being capable of circling around the vertical rotary spindle, the arm gripping the primary formed workpiece on the front surface side of the upsetter with a chuck provided at a tip end of the arm, wherein the first high speed multi jointed robot receives the primary formed workpiece from the workpiece discharging chuck of the workpiece feed/carry-out device, to convey/carry the primary formed workpiece into the forging press main body, wherein a second high speed multi jointed robot which has the same structure as the first high speed multi jointed robot is disposed between the upsetter and the round bar material feed device, and wherein the second high speed multi jointed robot receives the round bar material held on a bar material feeding route of the round bar material feed device, to deliver the round bar material to the workpiece feeding chuck of the workpiece feed/carry-out device.

3. The forging system for forging a valve according to claim 1 or claim 2, wherein a plurality of the forming stages are installed side by side horizontally on the front surface of the upsetter.

* * * * *